US006146152A

United States Patent [19]

McHugh et al.

[11] Patent Number: 6,146,152

[45] Date of Patent: Nov. 14, 2000

[54] LAND GRID ARRAY CONNECTOR

[75] Inventors: Robert G. McHugh, Evergreen, Colo.; Nick Lin, Hsin-Chuang, Taiwan; Jwo-Min Wang, Hsin-Dan, Taiwan; Shih-Wei Hsiao, Tu-Chen, Taiwan

[73] Assignee: Hon Hai Precision Ind. Co., Ltd., Taipei Hsien, Taiwan

[21] Appl. No.: 09/408,416

[22] Filed: Sep. 29, 1999

[51] Int. Cl.[7] ..... H01R 12/22

[52] U.S. Cl. ..... 439/66; 439/71

[58] Field of Search ..... 439/66, 70, 71, 439/862, 74

[56] References Cited

U.S. PATENT DOCUMENTS 3,960,424 6/1976 Weisenburger ..... 439/66

5,092,783 3/1992 Suarez et al. ..... 439/66

5,653,598 8/1997 Grabbe ..... 439/66

*Primary Examiner*—Gary F. Paumen

*Attorney, Agent, or Firm*—Wei Te Chung

[57] ABSTRACT

A contact comprises a central torsion beam, two side plates integrally connected to two ends of the central torsion beam and each side plate is perpendicular to the torsion beam. Two curved spring arms extend oppositely from a center portion of the torsion beam so that when the side plates are fixed in position and the curved spring arms are exerted opposite forces by two contact pads sandwiching the contact, the torsion beam will be twisted for a predetermined angle to transmit reactive forces to the curved spring arms to abut against the contact pads.

3 Claims, 7 Drawing Sheets

LAND GRID ARRAY CONNECTOR

BACKGROUND OF THE INVENTION

1. Field of The Invention

The present invention relates to a land grid array connector for electrically connecting a CPU to a printed circuit board.

2. The Prior Art

Land grid array (LGA) connectors are commonly used with IC packages and do not require soldering procedures during engagement between the LGA connector and a related printed circuit board (PCB). Normally, an LGA assembly includes an IC package having a plurality of flat contact pads formed on a bottom surface thereof, a connector having an insulative housing and defining a plurality of passageways therethrough, and a plurality of conductive contacts received in the passageways of the connector. Fastening means consisting of a top plate positioned on a top surface of the IC package, a bottom plate positioned on a bottom surface of the PCB, and a plurality of sets of aligned holes defined through the PCB, the top plate and the bottom plate are used to configure the assembly. Each set of aligned holes receives a screw therein which engages with a washer and a nut thereby sandwiching the LGA assembly between the top and bottom plates of the fastening means.

U.S. Pat. No. 5,653,598 discloses an electrical contact for use in a connector 30 between mutually opposed electrical interfaces 40, 99 such as contact pads respectively formed on an IC package 2 and a printed circuit board 9, as shown in FIG. 10. The conventional contact comprises a generally planar contact body 10 having first and second major faces 110, 120. The body includes a pair of spaced apart spring arms 140, 150 connected by a resilient bight portion 160. The spring arms 140, 150 each have a free end with an outwardly facing edge forming a contact nose 17, 18 for engaging with the corresponding interface 40, 99. Shorting sections 19, 20 generally extend toward each other from the free ends and are offset such that, upon deflection of the spring arms 140, 150 toward each other, the shorting sections 19, 20 overlap and the first major face 110 engages the second major face 120. Thus, a shortened electrical path is formed between the contact noses 17, 18 when the package 2 is urged against the connector 30.

With the conventional structure, the shorting sections 19, 20 may not properly contact each other due to unwanted lateral deflection thereof when the bight of the contact is deformed. Although the inner wall of the passageway receiving the contact may be used to limit the lateral deflection of the shorting sections 19, 20, unwanted scraping of the shorting sections 19, 20 against the inner wall of the passageway may occur thereby adversely affecting the proper overlap of the two shorting sections 19, 20. Proper overlap and engagement of the two shorting sections 19, 20 is difficult to achieve with this structure. Moreover, an additional contact resistance exists between the shorting sections 19, 20 thereby adversely affecting the signal transmission. Additionally, the spring arms 140, 150 occupy too much space especially in the length thereof which causes impossible for fine pitch requirement. It is requisite to provide a new LGA connector having contacts which can provide a relatively short transmission path without introducing an additional contact resistance when the contacts are urged by the package and the printed circuit board.

SUMMARY OF THE INVENTION

The primary purpose of the present invention is to provide a new LGA contact which can provide relatively strong normal force to two contact pads compressively sandwiching therearound when the LGA contact is urged by the two contact pads.

Another purpose of the present invention is to provide a new LGA connector which can achieve relatively short transmission path between an electrical package and a printed circuit board without introducing additional contact resistance inside the connector.

In accordance with one aspect of the present invention, a contact comprises a torsion beam plate substantially lying in a virtual plane, two side plates connected to two ends of the torsion beam plate, a curved spring arm extending from an edge section of the torsion beam plate and comprising an upper contacting section and a lower contacting section both of which are located at a same side with respect to the virtual plane. The upper contacting section is located at the highest physical level of the contact and the lower contacting section is located at the lowest physical level of the contact, so that when the side plates are fixed in position and the upper contacting section and the lower contacting section of the curved spring arm are respectively urged by two external contact pads sandwiching the contact, the torsion beam plate will be twisted for a predetermined angle to transmit reactive forces to the upper contacting section and the lower contacting section to abut against the contact pads, respectively.

In accordance with another aspect of the present invention, a land grid array connector comprises an insulative housing having a plurality of passageways defined therein, each passageway having a longitudinal wide hole and a lateral narrow hole communicating with and perpendicular to the longitudinal wide hole. A plurality of contacts each are received in one of the passageways and comprising a torsion beam plate substantially received in an intersection of the longitudinal wide hole and the lateral narrow hole of the passageway. Two engagement plates are connected to two ends of the torsion beam plate and fittingly retained in the lateral narrow hole of the passageway. A curved spring portion curvedly extends from an edge section of the torsion beam plate and comprises an upper contacting section and a lower contacting section both of which are located at a same side with respect to the intersection of the longitudinal wide hole and the lateral narrow hole. The upper contacting section and the lower contacting section are located out of the passageway and are compressive by two external contact pads sandwiching the contact, thereby causing the torsion beam plate to be twisted for a predetermined angle, which in turn transmits reactive forces to the upper contacting section and the lower contacting section to abut against the external contact pads, respectively.

DETAILED DESCRIPTION OF THE PREFERRED EMBODIMENT

Figure 1:
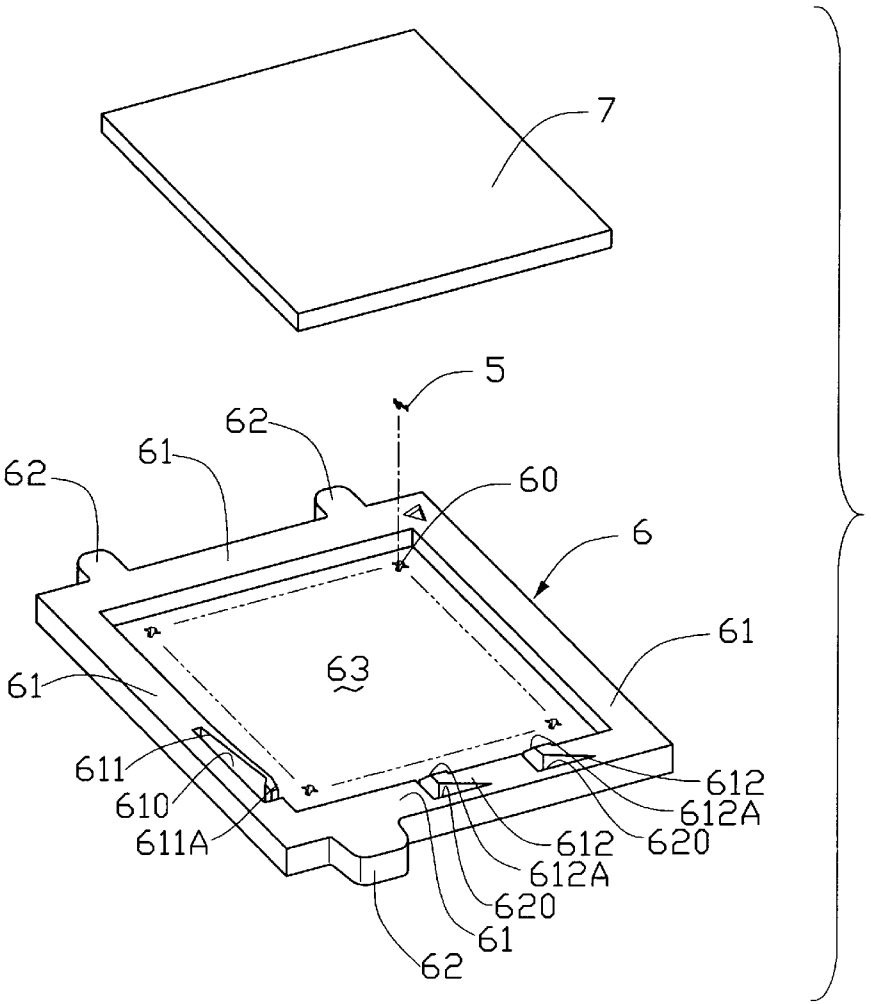
FIG. 1 is an LGA socket in accordance with the present invention for receiving a CPU package.
Figure 2:
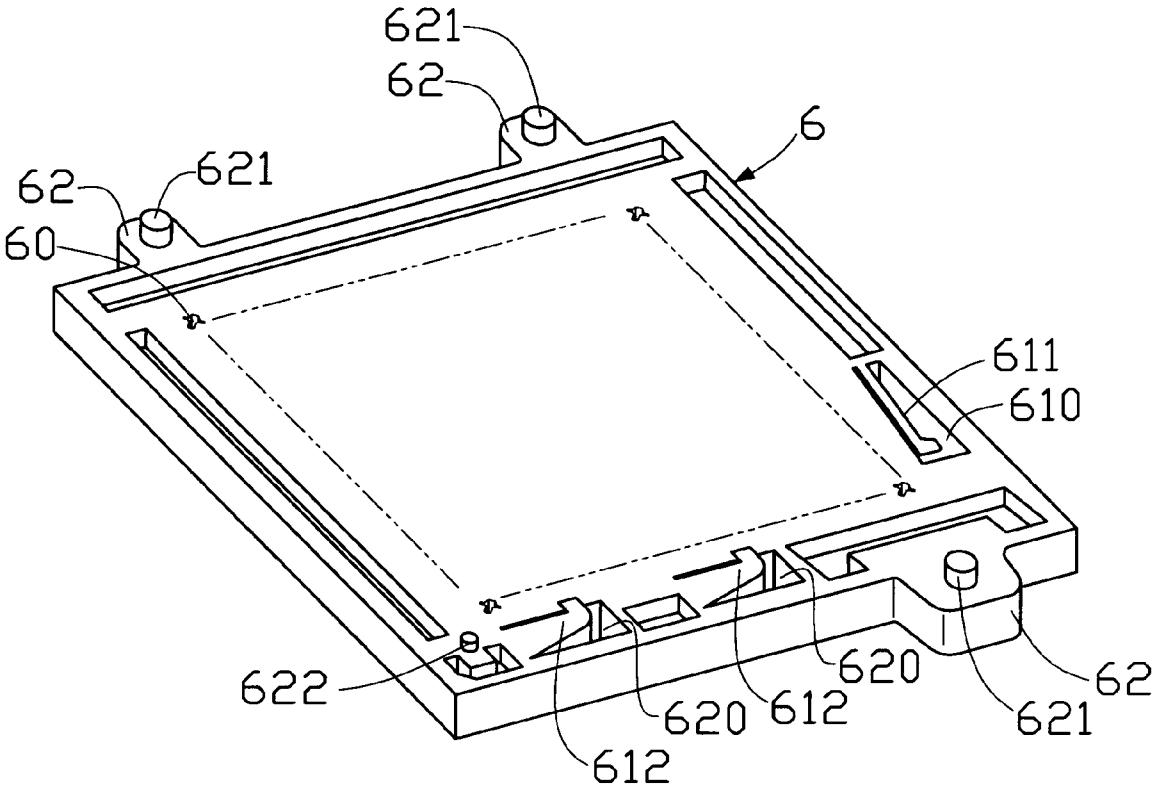
FIG. 2 is a perspective view of the LGA socket of FIG. 1 taken from a different angle.

Referring to FIGS. 1 and 2, an LGA connector in accordance with the present invention comprises an insulative housing 6 defining a plurality of passageways 60 therein for receiving LGA contacts 5. The housing 6 is substantially a body having four raised sides 61 and a central cavity 63 defined between the four raised sides 61 and sized to receive an external electrical device such as a CPU package 7. The passageways 60 are defined through a bottom surface of the central cavity 63. The LGA contact 5 is received in each of the passageways 60. A first resilient arm 611 is formed in one of the four raised sides 61 and capable of deformation in a first space 610 defined in the raised side 61. Two second resilient arms 612 are formed in another raised side 61 adjacent to the one in which the first resilient arm 611 is formed. The second resilient arm 612 is capable of deformation in a second space 620 defined in the raised side 61. The first resilient arm 611 and the second resilient arms 612 each have a chamfer surface 611A, 612A respectively formed in an upper edge thereof for guiding insertion of the CPU package 7 to the central cavity 63. The CPU package 7 is fixed in the cavity 63 by normal force originated from the deformation of the resilient arms 611, 612. Three ears 62 extend from opposite raised sides 61 near three corner of the housing 6 and each ear 62 has a post 621 extending downward for fixing within openings (not shown) of a printed circuit board 9 (see FIG. 6). Similarly, an additional post 622 extending from the bottom of the housing 6 near another corner thereof for fixing within another opening (not shown) of the printed circuit board 9.

Figure 4:
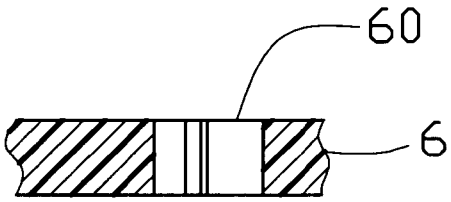
FIG. 4 is a cross-sectional view taken from line 4—4 of FIG. 3.
Figure 3:
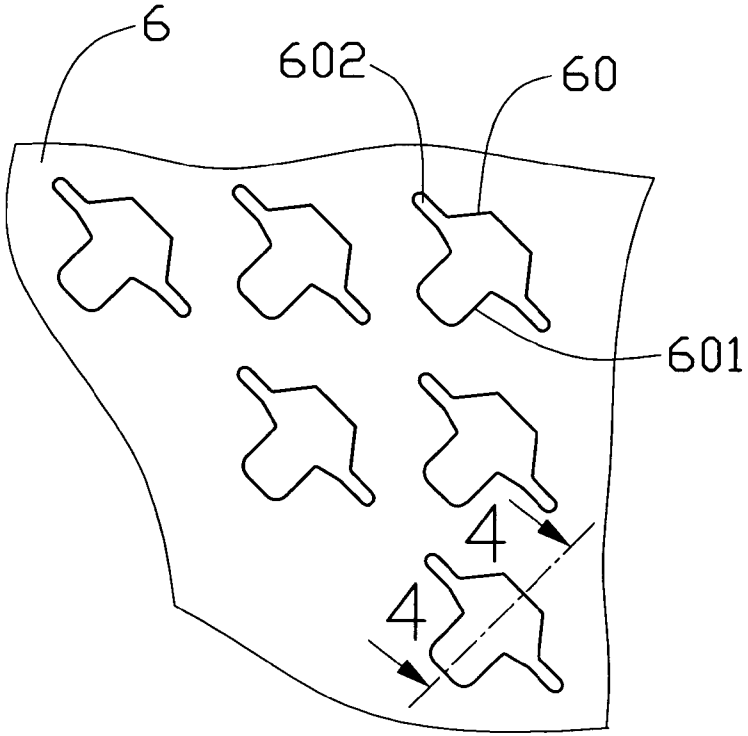
FIG. 3 is an enlarged top view of several passageways of FIG. 1.

Referring to FIGS. 3 and 4, each passageway 60 has a longitudinal wide hole 601 and a lateral narrow hole 602 communicating with and perpendicular to the longitudinal wide hole 601. The lateral narrow hole 602 is diverged to the longitudinal wide hole 601, therefore the end portions of the lateral narrow hole 601 are narrower than the other portions thereof.

Figure 5:
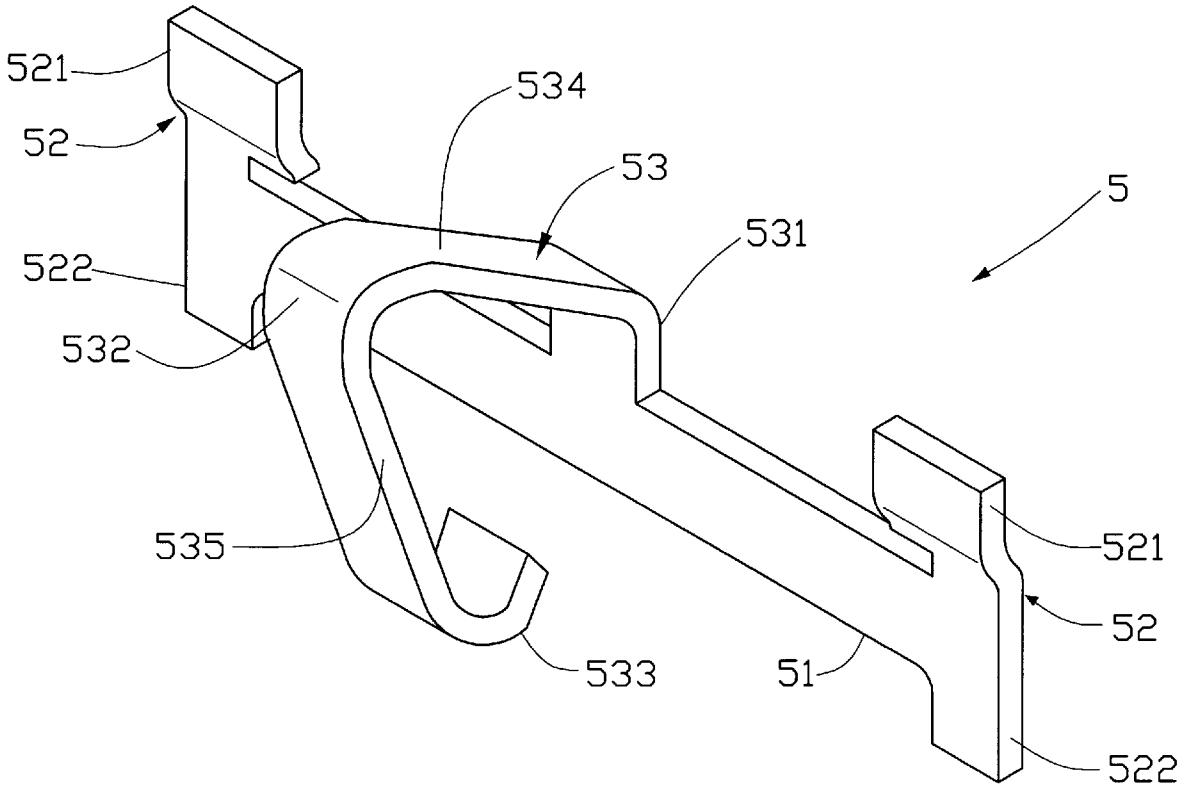
FIG. 5 is an enlarged perspective view of the contact shown in FIG. 1.
Figure 6:
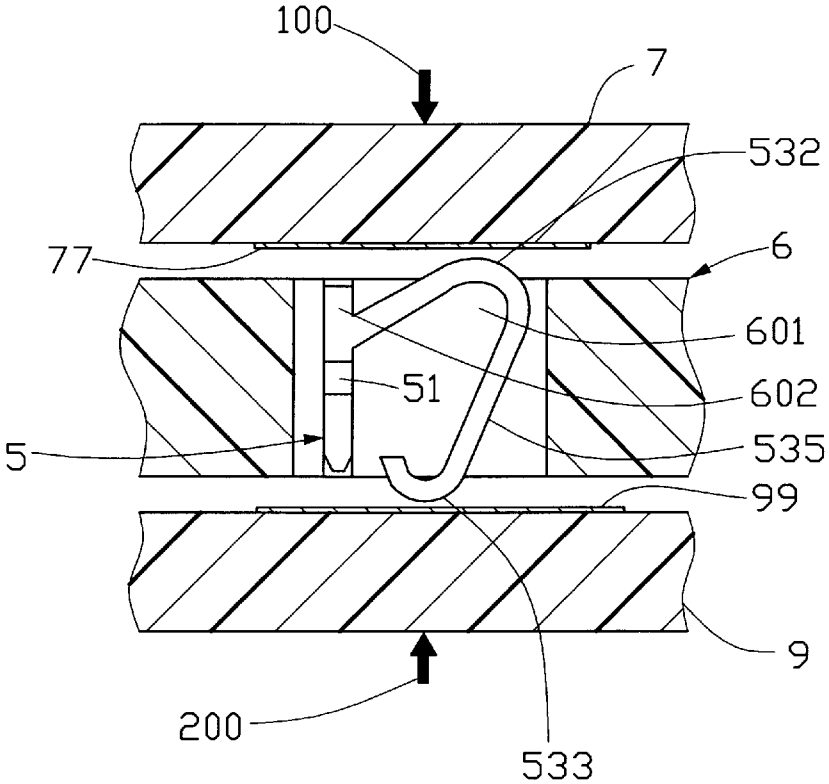
FIG. 6 is a schematic view showing a portion of the socket and two electrical devices before sandwiching the socket.

Referring to FIGS. 5 and 6, the CPU package 7 has a plurality of contact pads 77 (only one is shown for simplicity) and the printed circuit board 9 also has a plurality of contact pads 99 (only one is shown)and each pair of contact pads 77, 99 are arranged to register with each other. The contact 5 comprises a central torsion beam 51, two engagement plates 52 integrally connected to two ends of the central torsion beam 51 and each respectively perpendicular to the torsion beam 51, a spring arm 53 extending from a center section of the torsion beam 51. Each engagement plate 52 has a plan narrower lower portion 522 for facilitating the load-in of the contact 5 into the passageway 60 and a curved wider upper portion 521 for firmly engaging with the end portion of the lateral narrow hole 602 after the contact 5 is loaded into the passageway 60. Each spring arm 53 has a first curved section 531 extending from the torsion beam 51, a first straight section 534 connected to the first curved section 531, a second curved section 532 connected to the first straight section 534, a second straight section 535 connected to the second curved section 532, and a third curved section 533 connected to the second straight section 535. The second curved section 532 and the third curved section 533 are respectively located in the top level and the bottom level of the contact 5 and respectively function as upper contacting section and lower contacting section to external contact pads 77, 99 of the CPU package 7 and the printed circuit board 9 as explained later.

Figure 7:
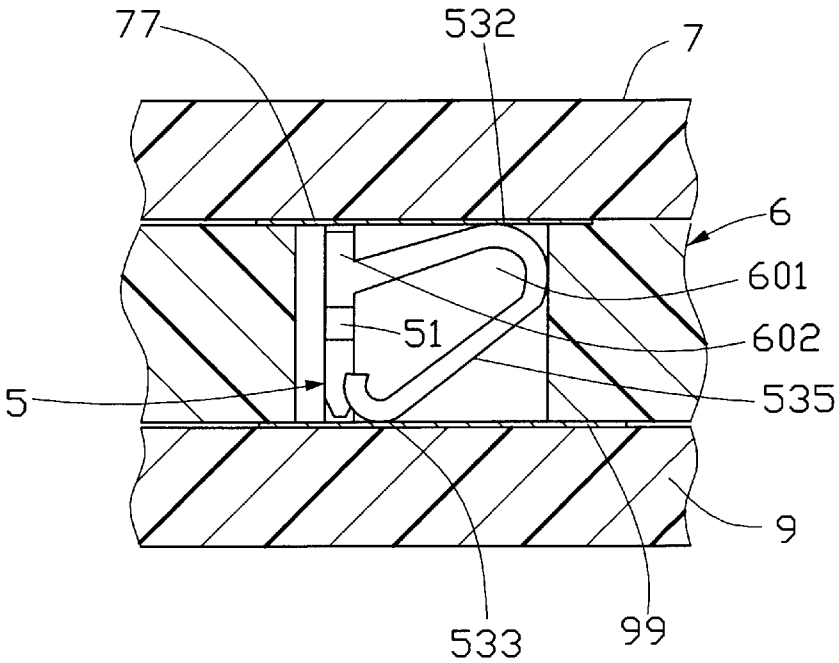
FIG. 7 is a schematic view showing a portion of the socket and two electrical devices sandwiching the socket.

Each pair of the contact pads 77 and 99 respectively register with the second curved section (upper contacting section) 532 and the third curved section (lower contacting section) 533 of the same contact 5 of the LGA connector. The CPU package 7 and the printed circuit board 9 respectively exert opposite forces 100, 200 on the contact 5 by a clip or screws (not shown) thereby causing the central torsion beam 51 to be twisted for a predetermined angle which in turn providing a normal force to the second curved section 532 and the third curved section 533 of the contact 5 to abut against the contact pads 77, 99 respectively as shown in FIG. 7. The spring arm 53 also deforms in the first curved section 531, the second curved section 532, and the third curved section 533 to provide the second curved section (upper contacting section) 532 and the third curved section (lower contacting section) 533 another normal force to abut against the contact pads 77, 99. Meanwhile, an electrical transmission path from the CPU package 7 to the printed circuit board 9 is built by the contact pad 77, the second curved section 532, the second straight section 535, the third curved section 533, and the contact pad 99.

Figure 8:
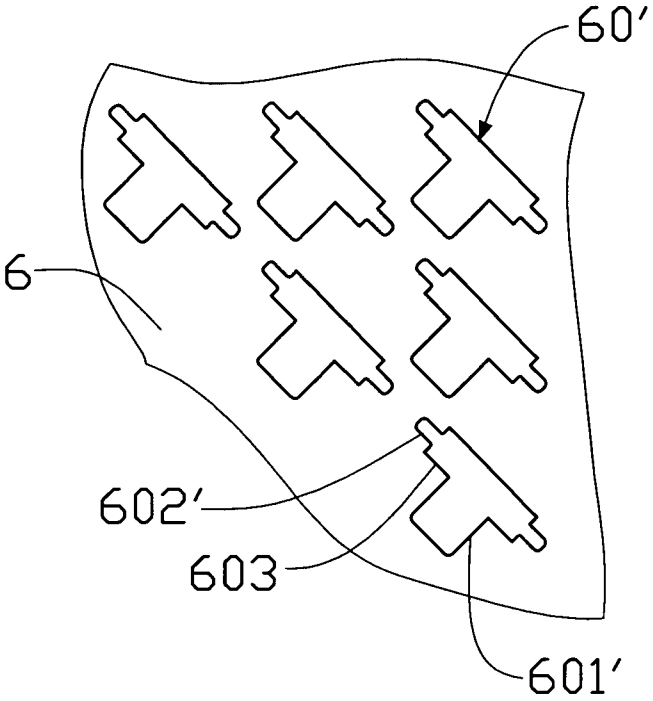
FIG. 8 is a second embodiment of the passageways taken from a top view.
Figure 10:
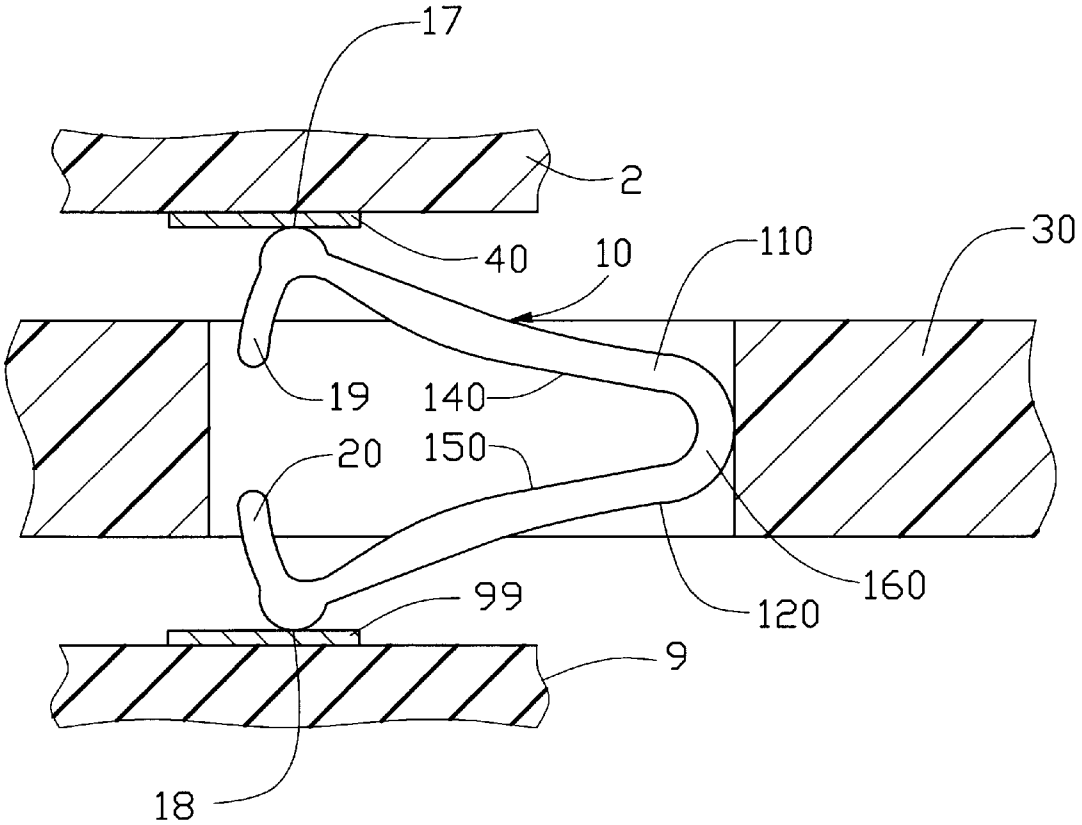
FIG.10 (PRIOR ART)
FIG. 10 is a schematic view of a conventional contact received in an LGA connector and sandwiched between an IC package and a printed circuit board.

The shape of the passageway 60 may be varied from that shown in FIG. 3. FIG. 8 illustrates a second embodiment of a passageway 60' which includes a longitudinal wide hole 601' and a lateral narrow hole 602' substantially perpendicular to the longitudinal wide hole 601'. Similar to previous embodiment, the engagement plates 52 of each contact 5 is retained in the lateral narrow hole 602' and the spring arms 53 are deformable in the longitudinal wide hole 601'. An intermediate hole 603 which is wider than the lateral hole 602' and communicated between the longitudinal wide hole 601' and the lateral narrow hole 602' is used for providing enough space for rotation of the torsion beam 51 of the contact 5.

Figure 9:
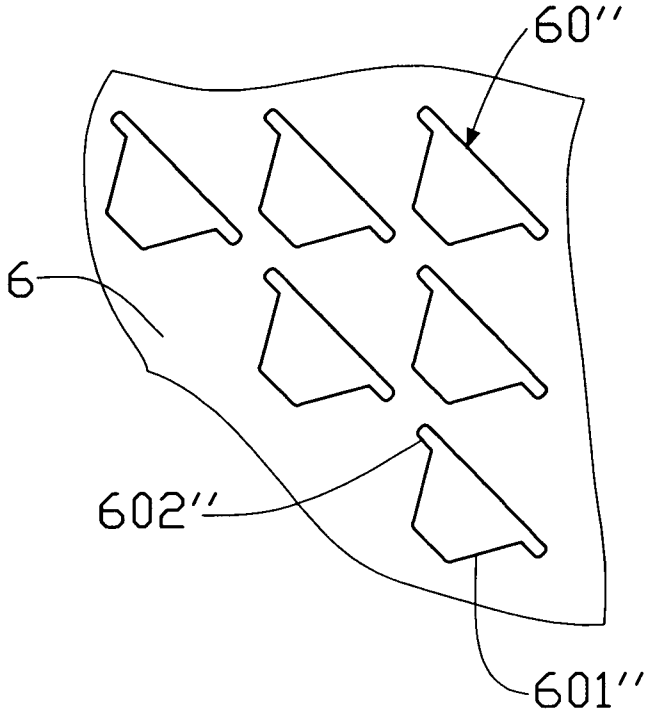
FIG. 9 is a third embodiment of the passageways taken from a top view.

The shape of the passageway 60 may also be varied from that shown in FIG. 8. FIG. 9 illustrates a third embodiment of a passageway 60" which includes a longitudinal wide hole 601" and a lateral narrow hole 602" communicating with the longitudinal wide hole 601". The engagement plates 52 of the contact 5 are engaged within the lateral narrow hole 602" and the torsion beam 51 of the contact 5 is rotatably received in the longitudinal wide hole 601".

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A contact comprising a torsion beam plate substantially lying in a plane, two side plates connected to two ends of the torsion beam plate, a curved spring arm extending from an edge section of the torsion beam plate and comprising an upper contacting section and a lower contacting section both of which are located at a same side with respect to the virtual plane, wherein the upper contacting section is located at the highest physical level of the contact and the lower contacting section is located at the lowest physical level of the contact, so that when the side plates are fixed in position and the upper contacting section and the lower contacting section of the curved spring arm are respectively engaged by two external contact pads sandwiching the contact, the torsion beam plate will be twisted for a predetermined angle to transmit reactive forces to the upper contacting section and the lower contacting section to abut against the contact pads, respectively;

wherein each side plate has a narrower lower portion and curved wider upper portion;

wherein the upper contacting section of the spring arm is distanced from the plane for a distance for generating a torque with respect to the torsion beam plate when the upper contacting section and the lower contacting section are engaged with the external contact pads;

further comprising an end portion curvedly extending upward from the lower contacting section.

2. A land grid array connector comprising an insulative housing having a plurality of passageways defined therein, each passageway having a longitudinal wide hole and a lateral narrow hole communicating with and perpendicular to the longitudinal wide hole;

a plurality of contacts each of which is received in one of the passageways and each contact comprising a torsion beam plate substantially received in an intersection of the longitudinal wide hole and the lateral narrow hole of the passageway, two engagement plates connected to respective ends of the torsion beam plate and fittingly retained in the lateral narrow hole of the passageway, a curved spring portion curvedly extending from an edge section of the torsion beam plate and comprising an upper contacting section and a lower contacting section both of which are located at a same side with respect to the intersection of the longitudinal wide hole and the lateral narrow hole, wherein the upper contacting section and the lower contacting section are located out of the passageway and adapted to be compressed with external opposite forces by two external contact pads sandwiching the contact, thereby causing the torsion beam plate to be twisted for a predetermined angle, which in turn transmits reactive forces to the upper contacting section and the lower contacting section to abut against the contact pads, respectively;

wherein the engagement plate has a narrower lower portion for facilitating load-in of the contact into the passageway and a curved wider upper portion connected to the narrower lower portion for firmly engaging with the lateral narrow hole after the contact is loaded into the passageway;

wherein the insulative housing has four raised sides between which a central cavity is defined for receiving the external electrical device, and the passageways are defined in a bottom of the central cavity;

wherein a first resilient arm and a second resilient arm are respectively formed in adjacent raised sides for fittingly retaining the external electrical device;

wherein the first resilient arm and the second resilient arm each have a chamfer surface respectively formed in an upper edge thereof for guiding insertion of the external electrical device to the central cavity.

3. A land grid array connector assembly comprising:

an insulative housing defining a plurality of passageways therein a plurality of contacts respectively received within the corresponding passageways, each of said contacts including a vertical plate and a curved spring portion extending therefrom, said curved spring portion including an upper contacting section upward extending from the vertical plate, and a lower contacting section downward extending from the upper contacting section, an upper apex of the upper contacting section projecting above an upper surface of the housing and a lower apex of the lower contacting section projecting below a lower surface of the housing when the contact is in a free status;

an upper board positioned on upper surfaces of the housing, and urging the upper contacting section to move downwardly; and a lower board positioned below the lower surface of the housing and urging the lower contacting section to move upwardly;

wherein the upper contacting section is actuated by the upper board to move away from the vertical plate while the lower contacting section is actuated by the lower board to move close to the vertical plate;

wherein the vertical plate is twisted when the upper contacting section and the lower contacting section are actuated to move;

wherein both said upper contacting section and said lower contacting section are located by the same side of the vertical plate.

* * * * *